United States Patent [19]

Goerens

[11] 4,044,539

[45] Aug. 30, 1977

[54] AERODYNAMIC RING TRAVELERS FOR YARN TWISTERS

[75] Inventor: Robert L. Goerens, Esch sur Alzette, Luxembourg

[73] Assignee: Uniroyal Luxembourg S.A., Steinfort, Luxembourg

[21] Appl. No.: 750,795

[22] Filed: Dec. 15, 1976

[30] Foreign Application Priority Data

Dec. 23, 1975 Germany ..... 2558428

[51] Int. Cl.[2] ..... D01H 7/60

[52] U.S. Cl. ..... 57/125

[58] Field of Search ..... 57/119–125

[56] References Cited

U.S. PATENT DOCUMENTS

| | | | |
|---|---|---|---|
| 631,342 | 8/1899 | Tetlow | 57/125 |
| 1,937,676 | 12/1931 | Wentworth | 57/125 |
| 2,111,544 | 3/1938 | Bassett | 57/125 |
| 2,111,545 | 3/1938 | Bassett | 57/125 |
| 2,116,071 | 5/1938 | Kempton | 57/125 |
| 2,118,873 | 5/1938 | Wentworth et al. | 57/125 |
| 2,121,647 | 6/1938 | Wentworth | 57/125 |
| 3,411,286 | 11/1968 | Wayson | 57/120 |
| 3,621,645 | 11/1971 | Furst | 57/119 |
| 3,664,113 | 5/1972 | Wayson | 57/125 |

FOREIGN PATENT DOCUMENTS

| | | | |
|---|---|---|---|
| 13,972 | 8/1956 | Germany | 57/125 |
| 722,807 | 2/1955 | United Kingdom | 57/125 |
| 766,697 | 1/1957 | United Kingdom | 57/125 |
| 820,723 | 9/1959 | United Kingdom | 57/125 |
| 964,966 | 7/1964 | United Kingdom | 57/125 |

*Primary Examiner*—John Petrakes
*Attorney, Agent, or Firm*—Norbert P. Holler

[57] ABSTRACT

Aerodynamically profiled ring travelers of generally ear-shaped configuration and designed for movement in only one direction along the inside of a ring of a yarn twister or like machine with minimized aerodynamic resistance and ring to traveler friction, are disclosed. Any such traveler is characterized by transverse cross-sectional configurations which have, as viewed in the intended direction of movement, an oblong shape with a relatively wider or more blunt leading edge and a relatively narrower or less blunt trailing edge, and which further have an airfoil shape in certain sections of the traveler that are so oriented as to cause lift forces to be generated at those sections in opposition to the centrifugal force and, if desired, also the yarn force, acting on the traveler when the same is in use. In accordance with the invention, the traveler is provided with at least one hollow space in the region of each airfoil-shaped section, thereby to enable enlargement thereof so as to make for generation of higher lift forces without any concomitant increases in the weight of the traveler. The same principle is also applicable to generally C-shaped travelers. This abstract is not to be taken either as a complete exposition or as a limitation of the present invention, however, the full nature and extent of the invention being discernible only by reference to and from the entire disclosure.

33 Claims, 17 Drawing Figures

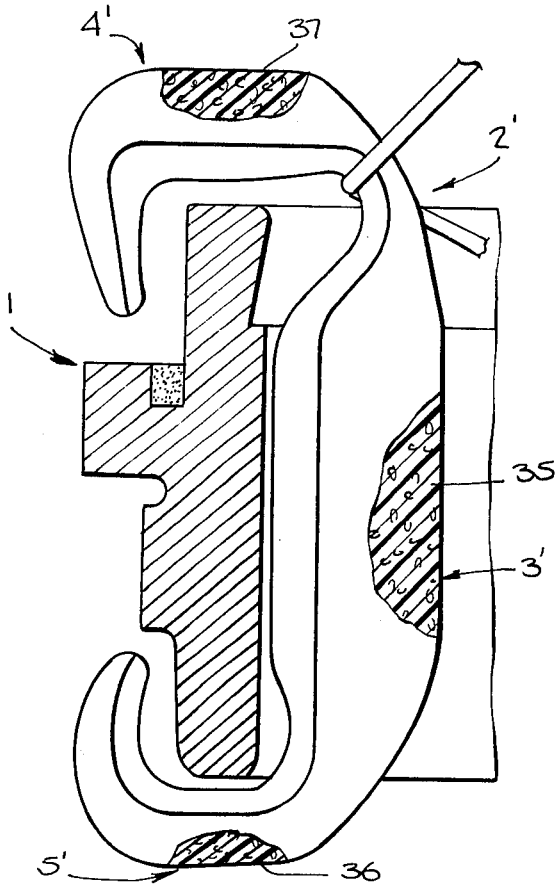
Fig. 10.
Fig. 9.
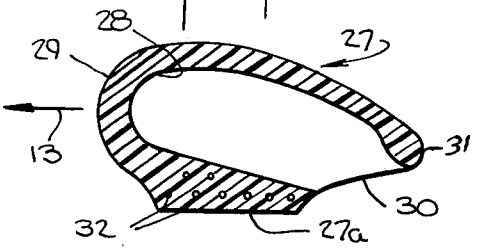
Fig. 11.
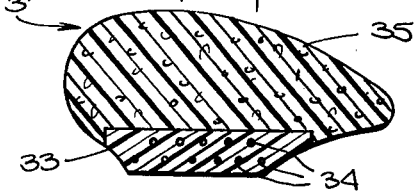
Fig. 14.
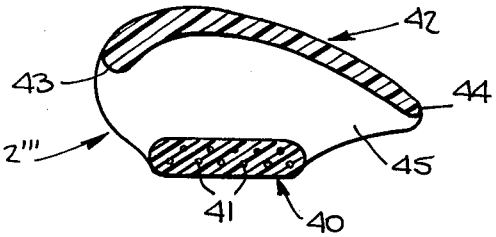
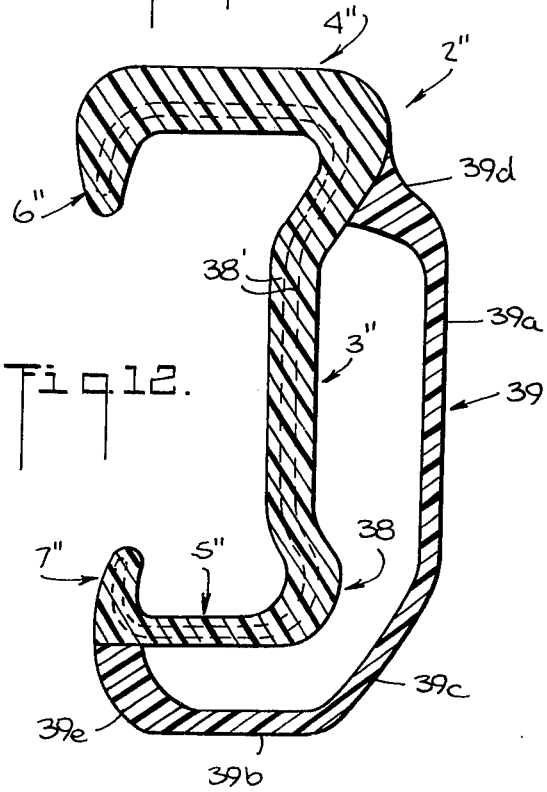
Fig. 12.
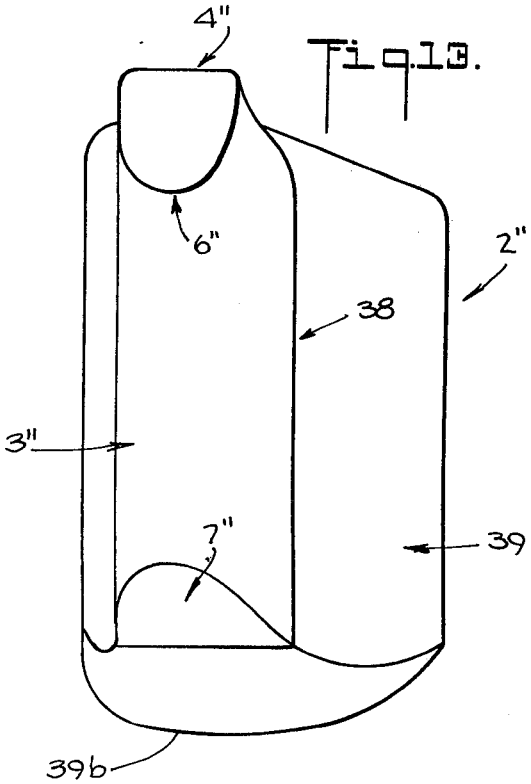
Fig. 13.

AERODYNAMIC RING TRAVELERS FOR YARN TWISTERS

This invention relates to aerodynamic ring travelers for yarn spinning or twisting machines, and in particular to such travelers which are intended for movement in only one predetermined direction along the ring. More specifically, the invention relates both to generally ear-shaped travelers such as are disclosed in the present applicant's prior U.S. Pat. No. 3,981,136 issued Sept. 21, 1976 and U.S. patent application Ser. No. 588,252 filed June 19, 1975, now U.S. Pat. No. 3,995,419 issued Dec. 7, 1976, and to generally C-shaped travelers such as are disclosed in the applicant's prior U.S. Pat. No. 3,961,470 issued June 8, 1976, all assigned to the same assignee as the instant application.

Generally speaking, an ear-shaped traveler of the class here under consideration has a main body section that lies at the inside of the ring when the traveler is in use and a pair of transverse upper and lower ring edge-bridging arms or end sections terminating in hook-like ends, and it has, in at least the main body section thereof, transverse cross-sectional configurations parallel to the plane of the ring which are oblong and airfoil-shaped with a more blunt leading edge and a less blunt trailing edge and with, for example, the larger portion of the cross-section located on that side of the line of greatest longitudinal dimension which faces toward the middle of the ring. The arrangement thus is such that when the traveler is in use, aerodynamic lift forces directed toward the middle of the ring are generated at the main body section. Similarly, in the arms or end sections, when the same are airfoil-shaped in cross-section, the larger portions of the cross-sections are located on the down sides of the respective longitudinal dividing lines so that aerodynamic lift forces directed downwardly of the ring will be generated.

Through this type of construction of an ear-shaped traveler, therefore, the aerodynamic lift forces which are directed toward the middle of the ring to a substantial degree compensate for or counteract the radially outwardly directed centrifugal forces acting on the traveler which tend to press the traveler against the inside of the ring. By the same token, the downwardly directed lift forces serve to counteract the upward components of the yarn force which tend to draw the lower arm against the bottom edge face of the ring. The result is to substantially reduce the contact pressure of the traveler against the ring. In this manner, it becomes possible to achieve either a substantially increased speed of movement of the traveler for at least the same service life of the traveler, or in the case of lower speeds of movement a substantially increased service life for the traveler.

A C-shaped traveler of the mentioned class, on the other hand, consists of an arched, thin, ring-bridging arm or guide portion for the yarn, and a transversely enlarged foot or base portion which is secured to one end of the guide portion but, in contrast thereto, is elongated in the direction of movement and has mutually perpendicular guide surfaces at one side for engaging the ring. In such a traveler, the foot or base has a longitudinal cross-section which is oblong with a more blunt leading edge and a less blunt trailing edge, and it may also be provided with a lift force-generating cross-section having its larger portion facing toward the middle of the ring. Here too, therefore, the lift forces which are directed toward the middle of the ring to a substantial degree compensate for or counteract the radially outwardly directed centrifugal forces acting on the traveler.

Experience has shown that providing a traveler with a cross-section which is either drop-shaped or otherwise symmetrically streamlined, so that the air resistance encountered by the traveler can be reduced, is fairly simple. By virtue of the small sizes of the cross-sections of ring travelers, however, it is very difficult to construct one having at one or more of its principal transverse planes an airfoil-like cross-section which will reliably ensure that at the intended high speeds of revolution there will be generated effective lift forces in such a manner that these will come into play in a predetermined direction and in a magnitude capable of influencing to an appeciable degree the behavior of the traveler in operation.

It is an object of the present invention, therefore, to provide means enabling the aforesaid drawbacks to be efficaciously overcome, and more particularly to provide a modification of the construction of travelers of the above described aerodynamic or airfoil types in such a manner that without any appreciable increase of the weight of the traveler the lift forces acting on the traveler can be influenced in a decisive fashion and to a substantial degree, so that the behavior of the traveler and its useful service life can be substantially improved and the efficiency of machines using such travelers substantially increased.

These objectives are achieved, in accordance with the basic principles of the present invention, by the provision of at least one hollow space in at least one, or in each, region of the airfoil profile cross-section of the traveler where aerodynamic lift forces are generated. Within this concept, the hollow space in a given traveler section can be unitary and relatively large, i.e. in the form of a cavity. Alternatively, however, it is also possible to provide in a given traveler cross-section a plurality of relatively small hollow spaces, for example in the form of open or closed cells formed in the material of which the respective section of the traveler is made. The term "at least one hollow space" as used herein should, therefore, be interpreted as encompassing either a cavity-type of space or a space in the nature of an open or closed cell or pore.

In this manner it becomes possible, at least in those sections of the traveler in which specifically directed aerodynamic lift forces are to be generated when the traveler is in use, to substantially enlarge the cross-section of the traveler which is of significance in the generation of lift forces, without at the same time increasing the weight of the traveler with respect to the weight of the heretofore known aerodynamic travelers. The basic concept of the invention thus entails effecting, by means of the provision of at least one hollow space in each or at least one airfoil profile section of the traveler, an increase in the ratio of the magnitude of the outer surface area of the traveler to its weight with reference to the corresponding ratio of the known aerodynamic travelers. This in turn makes it possible substantially to improve the relationship of the sought for generated aerodynamic lift forces to the other forces acting on the traveler, and thereby to exert a decisive influence on the behavior of the traveler while in operation.

This goal can still further be advantageously promoted by concentrating the strength of the traveler which is required for secure operation thereof, in predetermined and especially highly stressed regions of the traveler sections. Preferably this is effected through the expedient of reinforcing the strength of the material of which the traveler is made in these regions, for example by incorporating therein suitable reinforcing fibers, filaments, yarns or the like. With ring travelers, such as are currently commercial, in general being made of nylon, the use of a fibrous reinforcing material compatible with nylon, e.g. a material made of an aromatic polyamide of the type conventionally known as aramid fiber and available commercially under the registered trademark "KEVLAR," is especially advantageous. These fibers or fibrous reinforcing elements are, in this regard, embedded in the material of the traveler along a locus corresponding to the shape of the traveler, so that they generally follow the outline of the shape of the traveler (whether it be an ear-shaped or a C-shaped traveler). These reinforcing elements at the same time render the guide surfaces of the traveler, i.e. where it engages the ring or is engaged by the yarn, more wear resistant. Apart from that, those walls or parts of the traveler which remain entirely constituted of the basic synthetic plastic material can be made relatively thinner by virtue of the enhanced strength afforded by the reinforcing fibers or the like, which further contributes substantially to the minimization of the total weight and thereby to the desired increase of the ratio of outer surface area to weight.

The foregoing and other objects, characteristics and advantages of the present invention will be more clearly understood from the following detailed description thereof when read in conjunction with the accompanying drawing, in which.

Figure 1:
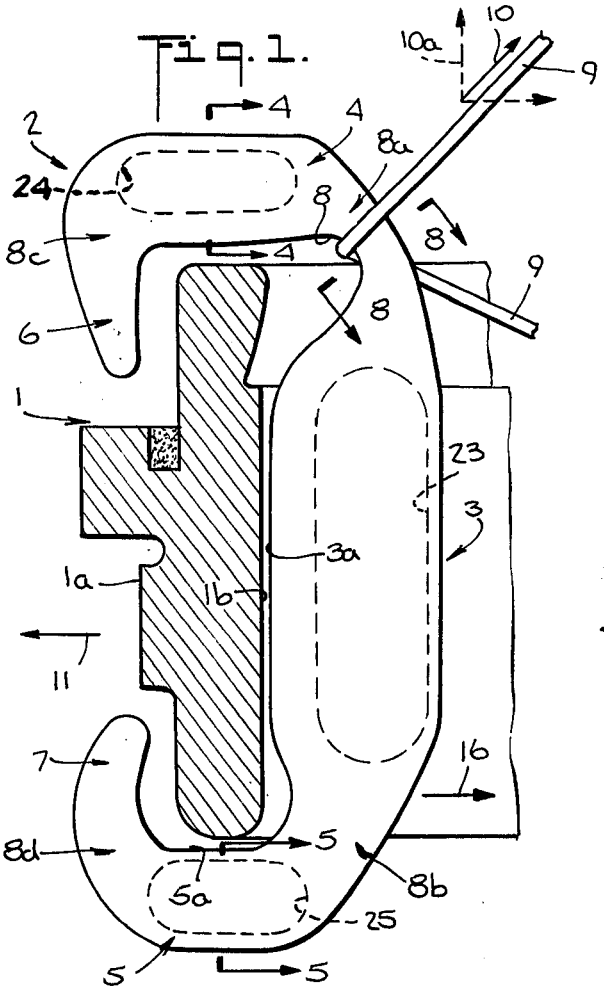
FIG. 1 is an elevational view of an ear-shaped traveler according to one embodiment of the invention, as seen from behind, i.e. looking in the intended direction of movement, the traveler being shown in operating relation to the ring (shown in a diagrammatic form only) of a spinning or twisting machine.
Figure 2:
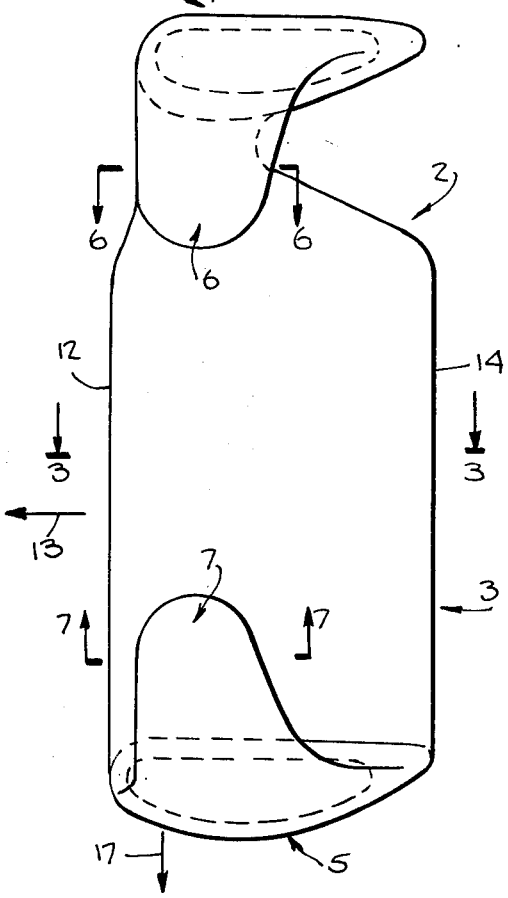
FIG. 2 is a side elevational view of the traveler shown in FIG. 1 as seen from the left, i.e. looking in the direction of the middle of the ring (not shown in this view)
Figure 3:
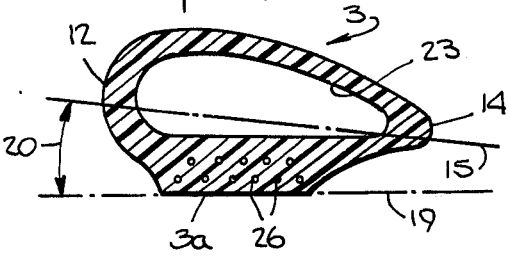
FIG. 3 is a sectional view illustrating the hollowed-out lift-generating profile and associated reinforced wear surface of the main body section of the traveler shown in FIGS. 1 and 2, the view being taken along the line 3—3 in FIG. 2.
Figure 4:
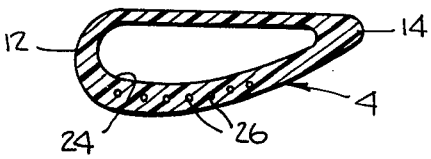
Figure 5:
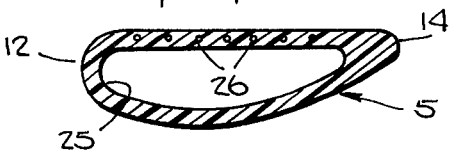
Figure 6:
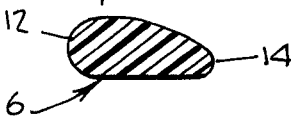
Figure 7:
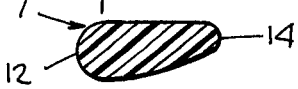
Figure 8:
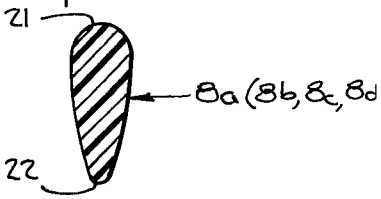
Figure 15:
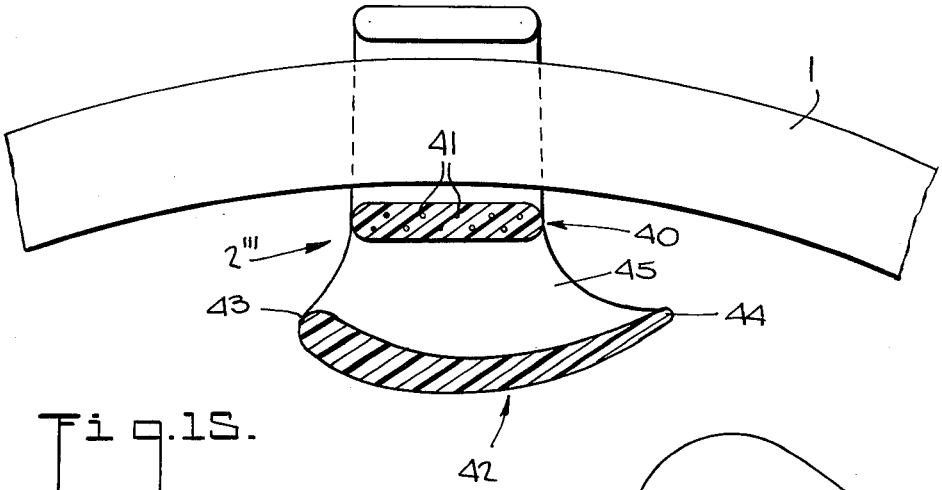
Figure 17:
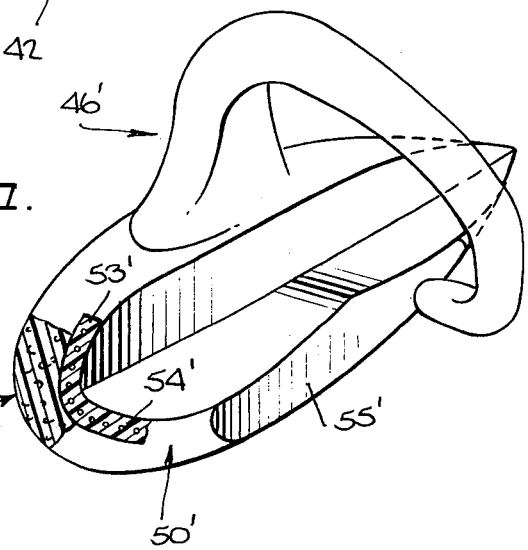
Figure 16:
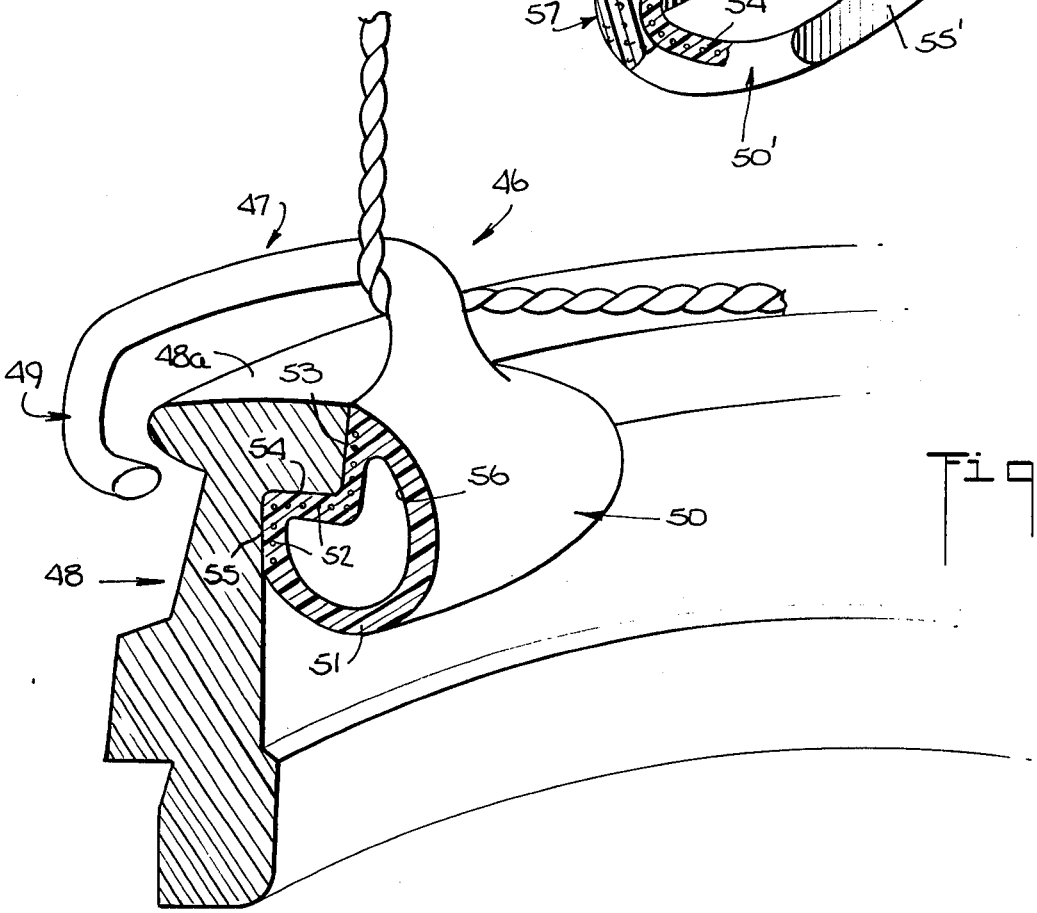

FIGS. 4 and 5 are sectional views illustrating, respectively, the hollowed-out lift-generating profiles of the upper and lower arms or end sections of the traveler, the views being taken along the lines 4—4 and 5—5 in FIG. 1;

FIGS. 6 and 7 are sectional views illustrating, respectively, the lift-generating profiles in the upper and lower hook ends of the traveler, the views being taken along the lines 6—6 and 7—7 in FIG. 2;

FIG. 8 is a sectional view illustrating the neutral profile of the transition sections between the main body section and the arms of the traveler and between the arms and the hook ends, the view being a representative one taken along the line 8—8 in FIG. 1;

FIG. 9 is a sectional view which is generally similar to FIG. 3 and is intended to illustrate a somewhat modified manner of forming the hollowed-out lift-generating profile of the main body section, and also of the arms or end sections, of the traveler;

FIG. 10 is a partly sectional rear elevational view, similar to FIG. 1, of an ear-shaped traveler according to another embodiment of the present invention wherein a cellular material is used to provide the hollow spaces;

FIG. 11 is a sectional view which is generally similar to FIGS. 3 and 9 and is intended to illustrate the cellular lift-generating profile of the main body section, and also of the arms or end sections, of the traveler shown in FIG. 10;

FIG. 12 is a rear elevational view, in section, of an ear-shaped traveler utilizing in the main body section and in the lower arm or end section, a hollowed-out lift-generating profile according to another embodiment of the present invention;

FIG. 13 is a side elevational view, similar to FIG. 2, of the traveler of FIG. 12 as seen from the left;

FIG. 14 is a sectional view which is generally similar to FIGS. 3, 9 and 11 and is intended to illustrate yet another modified manner of forming the hollowed-out profile of the main body section, and also of the lower arm or end section, of the traveler of FIGS. 12 and 13;

FIG. 15 is a horizontal sectional view of a traveler according to FIG. 14, shown as mounted on a ring;

FIG. 16 is a perspective elevational view, partly in section, of a C-shaped traveler (shown as mounted on a ring) according to one embodiment of the present invention and illustrates the use of a cavity-like space in the lift-generating portion of the foot or base of the traveler; and FIG. 17 is a perspective elevational view, partly in section, of a C-shaped traveler in accordance with another embodiment of the present invention and illustrates in diagrammatic form the use of a cellular material to provide the hollow spaces in the lift-generating portion of the base or foot of the traveler.

Referring now to the drawings in greater detail, in FIG. 1 there is shown a section of a ring 1 of conventional form having outside and inside surfaces 1*a* and 1*b*. Mounted on the ring 1 is an ear-shaped traveler 2 according to one embodiment of the invention. The traveler has a main body section 3 which extends generally vertically through the inside of the ring and has a guide or contact surface 3*a* facing the inner surface 1*b* of the ring. The traveler further has upper and lower arms or end sections 4 and 5 which extend generally horizontally across the upper and lower edges of the ring and terminate in generally hook-like ends 6 and 7 mutually inwardly directed over the upper and lower regions of the outer ring surface 1*a*. Respective transition sections 8*a* and 8*b* connect the main body section 3 to the arms 4 and 5, and respective transition sections 8*c* and 8*d* connect the arms to the hook-like ends 6 and 7. The inside of the transition section 8*a* defines a guide surface 8 over which the yarn 9 slides in its movement to the spindle (not shown).

In the operation of a ring twister or like machine, as is well known, the yarn 9 being wound up on the spindle drags the traveler behind it, so that the traveler, as it is being guided in the ring and runs around the latter at high speeds, tends to assume an inclined position with respect to the vertical because of the yarn force designated by the arrow 10. The yarn force has, among others, an upwardly directed component which is designated by the arrow 10*a* and tends to pull the traveler upwardly so as to bring the guide or contact surface 5*a* of the lower arm 5 against the bottom edge of the ring. Because of the weight and the high speed of movement of the traveler, of course, the traveler is also subjected to substantial centrifugal forces which are indicated by the arrow 11 and which tend to press the traveler at its guide surface 3*a* strongly against the inner surface 1*b* of the ring.

In order to compensate at least in part for these forces, the ear-shaped traveler 2 shown in FIGS. 1 and 2 exhibits in certain sections thereof a cross-sectional profile which is not only streamlined but also is so formed that at the high speeds of movement of the traveler it permits aerodynamic lift forces directed in a predetermined fashion to act on the traveler. To this end, the traveler 2, as illustrated in FIGS. 1 to 7, is provided in the main body section 3 thereof, in each of the arms or end sections 4 and 5, and in each of the hook-like ends 6 and 7, with an airfoil-shaped profile characterized by a generally oblong shape with a relatively blunt leading edge 12, i.e. the edge which faces in the direction of movement of the traveler designated by the arrow 13 in FIG. 2, and by a relatively less blunt trailing edge 14, i.e. the edge which faces opposite to the direction of movement. The airfoil shape is such that with respect to a given longitudinal dividing line, such as the line 15 of maximum dimension of the cross-section (the line is shown in broken-line form only in FIG. 3 but the same applies to FIGS. 4 to 7), the larger part of the cross-sectional area lies to one side of the line. In particular, it lies on the side of the line facing horizontally inwardly toward the middle of the ring in the case of the main body section 3, on the side of the line facing downwardly toward the top edge of the ring in the case of the upper arm or end section 4, on the side of the line facing downwardly away from the bottom edge of the ring in the case of the lower arm or end section 5, and on the side of the line facing horizontally toward the outer surface 1*a* of the ring in the case of the hook-like ends 6 and 7. In these regions, therefore, when the traveler is in use and moving at high speeds, aerodynamic lift forces are generated which are directed either radially inwardly of the ring, as indicated by the arrow 16 in FIG. 1, to counteract the effect of the centrifugal forces, or vertically downwardly relative to the ring, as indicated by the arrow 17 in FIG. 2, to counteract the effects of the upward component of the yarn force.

It will be noted that in FIG. 3, where a broken line 19 representing the inner surface 1*b* of the ring (against which the guide surface 3*a* of the traveler tends to bear) is shown, the longitudinal dividing line 15 of the section (which in this case corresponds to the maximum dimension of the section as measured from the leading to the trailing edge thereof) diverages from the line 19 in the direction of movement 13 at an angle 20, being inclined away from the line 19 in the direction of the middle of the ring (as viewed in the direction of movement). This angle, which is the angle of attack of the section, preferably is between about 5° and 30°, but it may be smaller (even 0° to dispose the line 15 parallel to the line 19) if the structural configuration of the airfoil cross-section is otherwise such as to cause the required aerodynamic lift forces to be generated when the traveler is in use and moving along the ring.

The transition sections of the traveler, by way of contrast to the main body section 3 and the arms 4 and 5, can have any profile or cross-sectional configuration that is aerodynamically favorable, i.e. streamlined, but is neutral as far as lift generation is concerned. Such a construction is illustrated in FIG. 8 which, in the first instance, shows the cross-sectional configuration of the transitional section 8*a* between the main body section 3 and the upper arm 4. As before, the cross-sectional configuration is oblong in shape and has a more blunt leading edge 21 and a less blunt trailing edge 22, but its particular shape is now generally drop-like and essentially symmetrical with respect to a longitudinal dividing line (not shown) of the section, or a line of maximum dimension thereof, passing through the leading and trailing edges of the section. As indicated by the reference numerals in parentheses, the other transition sections 8*b*, 8*c* and 8*d* of the traveler can, and normally will, have the same generally drop-shaped profile, but it will be understood that the cross-sectional configuration of any given transition section can differ somewhat in size and shape from the one illustrated in FIG. 8, if such a difference is dictated by the cross-sectional configurations of the respective adjoining sections of the traveler. The only invariable requirement for the transition sections is that, apart from being streamlined, i.e. as aerodynamically favorable as possible, they should be neutral insofar as lift generation is concerned.

It will be understood, of course, that as in the cases of the applicant's earlier generation ear-shaped aerodynamic travelers, the form of the traveler 2 can be modified somewhat for additional effects. Merely by way of example, the main body section 3 of the traveler can be made in such a way that the lift force generated thereby and directed toward the center of the ring 1 will be greater in the lower region of the traveler than in its upper region, thereby to compensate not only for centrifugal forces but also for the tilting moment generated by the yarn tension.

The present invention, in departing from the aforesaid known constructions as a starting point, is based on the recognition that the aerodynamic lift force acting on any given airfoil-like cross-sectional element of an ear-shaped traveler is to a great extent dependent on the magnitude of the circumference of that element. The basic concept of the present invention, therefore, is twofold: on the one hand to provide an ear-shaped aerodynamic traveler of the aforesaid types with a modified construction, in which each cross-sectional element of each lift force-generating section has an appreciably enlarged circumference in comparison to the circumference of the corresponding element of an airfoil section of any of the known aerodynamic travelers, so as to enable a greater lift force to be generated, and on the other hand to achieve this goal without a concomitant increase in the mass or weight of the cross-sectional element and thus of the traveler. To this end, the present invention contemplates the provision of at least one hollow space in at least one, and preferably in each, lift force-generating section of the traveler.

Within this basic concept, the entire traveler can be made hollow, e.g. constructed of two separately formed half shells which are fixedly joined by adhesive bonding, heat-sealing, or the like. Preferably, however, as shown for the embodiment of the invention illustrated in FIG. 1, only those sections of the traveler 2 which generate appreciable aerodynamic lift forces are constructed hollow. The traveler thus has three large cavity-like hollow spaces 23, 24 and 25 in the main body section 3 and the upper and lower arms 4 and 5, repsectively. Because of the incorporation of these hollow spaces or cavities in the airfoil profile sections of the traveler 2, a substantial increase in the cross-sectional profile circumferences, in comparison to the corresponding profile circumferences which have characterized the heretofore known aerodynamic travelers, is achieved without any increase in the mass or weight of the traveler.

Incorporating these measures in an ear-shaped traveler in accordance with the principles of the present invention has made is possible, therefore, to increase quite substantially the ratio of the aerodynamic lift forces to the weight-dependent forces which act on the traveler when the same is in operation. More particularly, in the region of the main body section 3 of the traveler 2, it has now become feasible to generate aerodynamic lift forces directed toward the middle of the ring which appreciably compensate, to a greater extent than heretofore attainable, for the centrifugal forces acting on the traveler. The same holds true for the upper and lower arms or end sections 4 and 5 of the traveler, where the force which acts upwardly on the traveler by virtue of the yarn tension can now also be counteracted, to a greater extent than heretofore attainable, by the downwardly directed aerodynamic lift forces generated by the airfoil profile sections of the arms.

In this manner, improved running characteristics (quietness and stability, for example) of the traveler can be achieved, even at very high speeds of revolution, and also an appreciable reduction of the contact pressure between the guide surfaces 3*a* and 5*a* of the traveler and the juxtaposed surfaces of the ring. The traveler can thus be operated at increased speeds of revolution, through which in turn the efficiency of a machine utilizing such a traveler can be enhanced.

A traveler according to the present invention, being subject to substantial forces, must, of course, have a sufficient structural stability and strength. In order to impart the necessary strength to such a traveler, therefore, and yet to make any portions thereof which are made of solid synthetic plastic material (i.e. which do not have a hollow space therein) as thin as possible, it is contemplated that such a portion of the traveler may be reinforced by aligned or randomly oriented compatible fibers embedded in the material. Where such a traveler is made of nylon, as is currently the vogue in the industry, a reinforcing material which is especially suited for this purpose is an aromatic polyamide fiber (these fibers are also identified as aramid fibers) which is marketed by E. I. DuPont & Co. under the registered trademark KEVLAR. Since the properties of such fibers are fully described in detail in the technical literature (representative of these are DuPont Technical Information Bulletin K-1, December 1974, and "Chemiefasern Textil-Industrie," February 1974, pages 97 to 101), a discussion of these properties is not deemed necessary herein.

The fibers can be distributed throughout all solid material portions of the traveler either uniformly or non-uniformly, but preferably they should be oriented in alignment with the shape of the traveler running from the region of one of the hook-like ends to the other. They can, however, be in the main confined to the more highly stressed portions of the traveler, i.e. the main body section 3 and the end sections 4 and 5. Preferably, the fiber reinforcement is provided only in those portions of the outer surfaces of the traveler facing the ring, as is indicated diagrammatically at 26 in FIGS. 3 to 5.

In the embodiment of the traveler 2 shown in FIG. 1, the hollow spaces 23, 24 and 25 in the various sections 3, 4 and 5 of the traveler are shown as being completely enclosed, but this is not essential. In order to facilitate the manufacture of a hollow traveler, without appreciably adversely affecting its ultimate aerodynamic properties, the hollow spaces may be formed so as to be open outwardly of the traveler in the region of the trailing edge thereof. An example of this type of construction, by virtue of which the traveler can be produced as a one-piece unit of synthetic plastic material, is shown in cross-section in FIG. 9, which illustrates a section 27 of the traveler (here a part of the main body section but the principle applies as well to the end sections) at which to a substantial degree aerodynamic lift forces are generated when the traveler runs at high speed in its intended direction of movement.

The traveler section 27 has a large hollow space 28 provided therein which, with reference to the direction of movement of the traveler (denoted, as before, by the arrow 13), is closed at the leading edge 29 of the section and open at a region 30 located behind the guide surface 27*a* juxtaposed to the inside face of the ring, i.e. between the said guide surface and the trailing edge 31 of the section. As stated, the open construction of the hollow spaces in the arms or end sections of the traveler would be similar, with open ends corresponding to the opening 30 being provided in each case. Here too the wall portion of the traveler in which the guide surface 27*a* is defined has its strength materially enhanced by preferably aligned embedded reinforcing fibers 32. It will be readily apparent that the provision of such openings 30 in the appropriate regions of the lift-generating cross sections will not in any way interfere with the ability of such a traveler to have imparted thereto, without an increase in the weight of the traveler, a substantially enlarged airfoil-shaped outer surface by which to enable the generation of aerodynamic lift forces to be increased.

Referring now to FIGS. 10 and 11, the ear-shaped traveler 2' in accordance with the embodiment of the invention there shown has a relatively thin wall or shell portion 33 on the side facing the ring 1, which portion is made of solid, i.e. non-cellular, synthetic plastic material (like the entire traveler 2) and is reinforced by KEVLAR fibers 34. In lieu of a cavity-like hollow space, however, this traveler has the light-weight portion (or portions) thereof constituted of cellular or porous material secured in any suitable manner, for example by adhesion, heat sealing or the like, to the shell body portion 33.

Thus, as best shown in FIG. 11, the portion 35 of the main body section 3' which defines the aerodynamically active profile is made of cellular material, preferably also of nylon but not necessarily so. The same is true of the aerodynamically active portion 36 of the lower arm 5' of the traveler. In the upper arm 4', of course, the shell body 33 defines the lift force-generating, surface, and the rest of the section is constituted of the cellular material, here designated 37. By virtue of the lesser weight of the cellular material, in a traveler according to the embodiment of FIGS. 10 and 11 it is also possible to achieve a high value for the ratio of the magnitude of the outer surface to the weight of the traveler.

It will be understood that if a cellular or porous synthetic plastic material is available which is sufficiently wear-resistant, the entire traveler could be made of such material. Preferably, however, the manufacturing operation in that case would be so controlled in known fashion as to ensure that the outer surface of the traveler is closed, e.g. by means of a skin, and exhibits no open cells. Alternatively, if it is desired to achieve an especially high wear resistance without having to forego the use of any specific lightweight cellular material, the traveler can also be produced to have a core of cellular material encased in a shell or to be constituted of two half-shells filled with cellular material and joined together as suggested above with respect to FIG. 11.

An ear-shpaed traveler constructed in accordance with yet another embodiment of the present invention is shown in FIGS. 12 and 13. Here the traveler 2'' is provided with a shell-like primary body 38 of generally ear-shaped profile and defining a main body section 3'', upper and lower arms or end sections 4'' and 5'', and hook-like ends 6'' and 7'', the entire body 38 being made of solid, non-cellular material reinforced by KEVLAR fibers 38'. The wall thickness and thus also the weight of the primary body 38 are substantially reduced in comparison to the heretofore known travelers, and the thickness in fact does not depart from that of a conventional wear-resistant layer or facing. The body 38 has no airfoil cross-section anywhere. However, in order to enable the generation, in the lower end section 5'' and in the main body section 3'' of the traveler 2'', of the high downwardly and inwardly (of the ring) directed lift forces which determine the behavior of the traveler in operation, there is superimposed onto these sections of the primary body 38 an auxiliary body 39 in the form of a unitary inwardly open shell having at those sections a cross-sectional outer configuration essentially like that of the outer surface of the cellular material portion 35 illustrated in FIG. 11. The shell 39 thus would resemble the hollow lift force generating portions shown in FIGS. 3 and 9, for example, having airfoil profile segments 39*a* and 39*b* and neutral segments 39*c*, 39*d* and 39*e*. It will be seen, therefore, that the auxiliary body 39 substantially increases the size of the outer surface in the airfoil profile sections of the traveler without contributing significantly to an increase in the weight of the traveler. As an alternative, of course, the auxiliary body 39 can also be made of an open-celled or a closed-celled synthetic plastic material.

As a variant of the construction of the traveler 2'', it is contemplated by the present invention that the auxiliary airfoil profile-defining body in each lift force-generating section of the traveler may be arranged throughout at a radial spacing from the ring-mounting primary body and secured to the latter by means of transverse webs. Such a construction of the traveler 2''' is shown in FIGS. 14 and 15. Here again, the ring-mounted primary body 40 is made of solid synthetic plastic material, e.g. nylon, reinforced by a suitable fibrous matrix 41, e.g. KEVLAR fibers, and has the minimum possible cross-sectional thickness and weight, similar to the primary body 38 of the traveler 2'' shown in FIGS. 12 and 13. However, the auxiliary, airfoil profile-defining body 42, which as in all the other cases has an oblong shape with a more blunt leading edge 43 and a less blunt trailing edge 44, is a separate element and is connected with the primary body 40 by means of webs 45 only at the remote ends of the main body section and the lower arm or end section of the traveler, i.e. only at those locations where the auxiliary body 39 of the traveler 2'' engages the primary body 38. As will be apparent, therefore, the space between the primary and auxiliary bodies 40 and 42 in this embodiment of the invention constitutes the weight-reducing hollow space of the traveler. In this construction, of course, when the traveler is in use air will be able to pass between the primary and auxiliary bodies, but this will be of no significance as long as the auxiliary body has airfoil profiles in the main body and lower end sections of the traveler which will cause adequate aerodynamic lift-forces to be generated in the inward and downward directions.

The present invention has so far been explained primarily with reference to its implementation in an ear-shaped traveler. The described principles and measures can, however, also be applied to C-shaped travelers of the type hereinabove referred to and especially to the foot or base of such a traveler. Thus, as shown in FIG. 16, a C-shaped traveler 46 of this type has a generally arcuate mid-section 47 (which, when the traveler is mounted on a ring 48 of generally T-shaped cross-section, extends substantially horizontally across the top flange portion 48*a* of the ring) and two hook-like end sections 49 and 50 (of which the former is in the nature of a relatively thin tip engaging under the outer edge of the top ring flange and the latter is in the nature of an elongated and relatively widened base or foot engaging under the inner edge of the ring flange), with the base or foot having an airfoil-like configuration inwardly of the ring so as to generate corresponding aerodynamic lift forces tending to compensate for or counteract the centrifugal forces acting on the traveler during its movement along the ring. In accordance with the present invention, the foot or base 50 of such a traveler may be made in the form of a thin-walled shell 51 of solid synthetic plastic material, e.g. nylon, having a fibrous reinforcing matrix 52, e.g. KEVLAR fibers, embedded in the guide surface portions 53, 54 and 55 of the shell and provided with a cavity-like hollow interior space 56. On the other hand, as shown in FIG. 17, a C-shaped traveler 46' of this type may have the light-weight airfoil profile-defining portion 57 of its foot or base 50' made of a cellular or porous synthetic plastic material and located outwardly of the fiber-reinforced guide surface-defining shell sections 53', 54', 55'. The applicability of others of the hereinbefore described variants of the invention to the C-shaped travelers 46 and 46' will be apparent to those skilled in the art and thus requires no detailed description herein.

It will be understood that the foregoing description of the preferred embodiments of the present invention is for purposes of illustration only, and that the various structural and operational features and relationships herein disclosed are susceptible to a number of modifications and changes none of which entails any departure from the spirit and scope of the present invention as defined in the hereto appended claims.

What is claimed is:

1. In a ring traveler designed for movement in only one given direction along a ring of a yarn twister or like machine, which traveler (a) has streamlined cross-sectional contours as well as respective guide surfaces for sliding contact with the ring and for guiding the yarn to the spindle and (b) is provided, in a section thereof which lies at the inside face of the ring when the traveler is mounted thereon, with a generally airfoil-like cross-sectional configuration such that when the traveler is in motion aerodynamic lift forces are generated at said section which are directed toward the middle of the ring; the improvement which comprises a construction of said section of the traveler to define in said section and within the confines of said airfoil-like cross-sectional configuration thereof at least one hollow space, thereby to provide the traveler at said section with a maximized ratio of the magnitude of its outer surface to its weight.

2. A traveler as claimed in claim 1, wherein said hollow space in said section of the traveler is in the form of a relatively large cavity.

3. A traveler as claimed in claim 2, wherein said hollow space is open to the outside at a region of said outer surface of said section which faces away from said given direction of movement of the traveler.

4. A traveler as claimed in claim 2, wherein said hollow space is open to the outside at a first region of said outer surface of said section which faces away from said given direction of movement of the traveler and at a second region of said outer surface which faces in said given direction.

5. A traveler as claimed in claim 1, wherein at least said section of the traveler is made at least in part of a closed-cell or open-cell cellular synthetic plastic material the cells of which constitute a plurality of hollow spaces.

6. A traveler as claimed in claim 5, wherein at least in the regions of said guide surfaces of the traveler any portion of the latter which is made of cellular synthetic plastic material is covered by a wear-resistant layer of non-cellular synthetic plastic material.

7. A traveler as claimed in claim 6, wherein both said cellular synthetic plastic material and said non-cellular synthetic plastic material are nylon.

8. A traveler as claimed in claim 7, wherein said layer of non-cellular synthetic material is reinforced by a fibrous matrix of aramid fiber embedded therein.

9. A traveler as claimed in claim 1, wherein the traveler is made of synthetic plastic material and, in regions thereof which are highly stressed when the traveler is in motion along the ring, is reinforced by a fibrous matrix of a synthetic fiber compatible with said material.

10. A traveler as claimed in claim 9, wherein said fibrous matrix is embedded in said synthetic plastic material so as to be disposed along a locus paralleling the shape of the traveler.

11. A traveler as claimed in claim 1, wherein the traveler is made of nylon and, in regions thereof which are highly stressed when the traveler is in motion along the ring, is reinforced by a fibrous matrix of an aromatic polyamide fiber.

12. A traveler as claimed in claim 1, which traveler (c) is generally ear-shaped and (d) further has at the opposite ends of said first-named section respective upper and lower transverse end sections which lie across the upper and lower edges of the ring when the traveler is mounted thereon, with (e) said lower end section having a generally airfoil-like cross-sectional configuration such that when the traveler is in motion aerodynamic lift forces are generated at said lower end section which are directed downwardly of the ring; wherein said lower end section is constructed to define therein and within the confines of said airfoil-like cross-sectional configuration thereof at least one hollow space, thereby to further provide the traveler at said lower end section with a maximized ratio of the magnitude of its outer surface to its weight.

13. A traveler as claimed in claim 12, wherein said hollow space in said first-named section and said hollow space in said lower end section each is in the form of a relatively large cavity.

14. A traveler as claimed in claim 12, wherein at least said first-named section and said lower end section are made at least in part of a closed-cell or open-cell cellular synthetic plastic material the cells of which constitute respective pluralities of hollow spaces.

15. A traveler as claimed in claim 1, which traveler (c) is generally ear-shaped and (d) further has at the opposite ends of said first-named section respective upper and lower transverse end sections which lie across the upper and lower edges of the ring when the traveler is mounted thereon, with (e) said upper and said lower end section each having a generally airfoil-like cross-sectional configuration such that when the traveler is in motion aerodynamic lift forces are generated at said upper and lower end sections which are directed downwardly of the ring; wherein said upper and lower end sections are constructed to define therein and within the confines of each of the respective airfoil-like cross-sectional configurations thereof at least one hollow space, thereby to further provide the traveler at each of said upper and lower end sections with a maximized ratio of the magnitude of its outer surface to its weight.

16. A traveler as claimed in claim 15, wherein said hollow space in said first-named section and said hollow spaces in said upper and lower end sections each is in the form of a relatively large cavity.

17. A traveler as claimed in claim 15, wherein at least said first-named section and said upper and lower end sections are made at least in part of a closed-cell or open-cell cellular synthetic plastic material the cells of which constitute respective pluralities of hollow spaces.

18. An ear-shaped ring traveler designed for movement in only one given direction along a ring of a yarn twister or like machine, a. the traveler having a main body section, first and second transition sections at the opposite ends of said main body section, respectively, upper and lower arms extending generally codirectionally from said first and second transition sections, respectively, third and fourth transition sections at the ends of said upper and lower arms remote from said main body section, respectively, and upper and lower hook-like ends extending mutually inwardly toward one another from said third and fourth transition sections, respectively, b. of which, when the traveler is mounted on a ring, said main body section extends generally vertically across and moves translationally along the inside face of the ring, said upper and lower arms extend generally horizontally outwardly across and move translationally along the upper and lower edges of the ring, respectively, said upper and lower hook-like ends extend downwardly and upwardly, respectively, over and move translationally along the outside face of the ring, and said first transition section at its inside surface defines a guide surface for the yarn being twisted, c. the traveler having aerodynamically streamlined cross-sectional contours throughout, d. the cross-sectional configuration of any part of the traveler on a transverse plane perpendicular to the longitudinal dimension of the respective part being generally oblong in shape and having, as viewed with reference to said given direction of movement, a relatively blunt leading edge and a relatively less blunt trailing edge, e. said cross-sectional configuration of said main body section being airfoil-shaped and oriented, with reference to said given direction of movement, so as to generate, when the traveler is in motion along the ring, aerodynamic lift forces directed oppositely to and counteracting the centrifugal forces exerted on the traveler, thereby to urge said main body section out of frictional engagement with the inside face of the ring, f. said cross-sectional configuration of at least said lower arm being airfoil-shaped and oriented, with reference to said given direction of movement, so as as to generate aerodynamic lift forces directed downwardly with respect to the ring oppositely to and counteracting the upward component of the yarn force, thereby to urge said lower arm out of frictional engagement with the lower edge of the ring, and g. said main body section and at least said lower arm each being constructed to define therein and within the confines of their respective airfoil-shaped cross-sectional configurations at least one hollow space, thereby to provide the traveler with a maximized ratio of outer surface to weight at said main body section and at least at said lower arm.

19. A traveler as claimed in claim 18, wherein the traveler is made of nylon and, in regions thereof which are highly stressed when the traveler is in motion along the ring, is reinforced by a fibrous matrix of an aramid fiber.

20. A traveler as claimed in claim 18, wherein the cross-sectional configuration of said upper arm is also airfoil-shaped and oriented, with reference to said given direction of movement, so as to generate aerodynamic lift forces directed downwardly with respect to the ring, and said upper arm is also constructed to define therein and within the confines of its respective airfoil-shaped cross-sectional configuration at least one hollow space, thereby to provide the traveler with a maximized ratio of outer surface to weight at said upper arm as well.

21. A traveler as claimed in claim 18, wherein each of said hollow spaces in said main body section and at least said lower arm is in the form of a relatively large cavity.

22. A traveler as claimed in claim 21, wherein each of said hollow spaces is open to the outside at a respective region of said outer surface of the traveler which faces away from said given direction of movement of the traveler.

23. A traveler as claimed in claim 18, wherein the traveler at least at said main body section and said lower arm is made at least in part of a closed-cell or open-cell cellular synthetic plastic material the cells of which constitute a plurality of hollow spaces.

24. A traveler as claimed in claim 23, wherein at least in the regions of those surfaces of the traveler which in operation tend to be engaged either by the ring or the yarn, any portion of the traveler which is made of cellular synthetic plastic material is covered by a wear-resistant layer of non-cellular synthetic plastic material.

25. A traveler as claimed in claim 24, wherein both said cellular synthetic plastic material and said non-cellular synthetic plastic material are nylon.

26. A traveleras claimed in claim 25, wherein said layer is reinforced by a fibrous matrix of an aramid fiber embedded therein.

27. A C-shaped ring traveler designed for movement in a given direction along a ring of a yarn twister or like machine, wherein the ring is of generally T-shaped cross-section and has a generally upright annular web and at the top of the latter a pair of generally transverse circumferential flanges the free lateral edges of which face inwardly and outwardly of the ring, respectively, a. the traveler having a body including (i) a relatively thicker elongated foot or base section which, when the traveler is mounted on the ring, is juxtaposed to and moves longitudinally along the inside of the ring, and (ii) a relatively thinner transverse bowed or arched section which, when the traveler is mounted on the ring, extends generally horizontally across and moves translationally along the top of the ring, said bowed or arched section being secured to and extending laterally from a medial portion of said foot or base section and terminating in a hook-like free end which, when the traveler is mounted on the ring, extends in under said free lateral edge of and moves translationally along beneath said outwardly facing flange of the ring, b. said foot or base section of said body on the side thereof which, when the traveler is mounted on the ring, faces away from the center of the ring having (i) a pair of laterally and vertically offset, generally vertical guide surfaces for sliding engagement, respectively, with said free lateral edge of said inwardly facing flange and with the surface of said web beneath said inwardly facing flange, and (ii) a generally horizontal guide surface intermediate and bridging the gap between said vertical guide surfaces for sliding engagement with the underside of said inwardly facing flange, c. said foot or base section of said body having throughout its expanse, except at the locations of said vertical and horizontal guide surfaces, a cross-sectional configuration (i) which has, as viewed with reference to said given direction of movement of the traveler, a relatively blunt leading edge and a relatively less blunt trailing edge, and (ii) which is generally airfoil-like and so oriented with reference to the longitudinal axis of said foot or base section as to generate, when the traveler is in motion along the ring, aerodynamic lift forces directed oppositely to and counteracting the centrifugal forces exerted on the traveler, thereby to urge said vertical guide surfaces of said foot or base section out of frictional engagement with said free lateral edge of said inwardly facing flange and with the surface of said web beneath said inwardly facing flange, and d. said foot or base section of the traveler being constructed to define therein and within the confines of said airfoil-like cross-sectional configuration thereof at least one hollow space, thereby to provide the traveler at said foot or base section with a maximized ratio of outer surface to weight.

28. A traveler as claimed in claim 27, wherein at least said foot or base section of the traveler is made of nylon and, in regions thereof which are highly stressed when the traveler is in motion along the ring, is reinforced by a fibrous matrix of an aramid fiber.

29. A traveler as claimed in claim 27, wherein said hollow space in said foot or base section of the traveler is in the form of a relatively large cavity.

30. A traveler as claimed in claim 27, wherein at least said foot or base section of the traveler is made at least in part of a closed-cell or open-cell cellular synthetic plastic material the cells of which constitute a plurality of hollow spaces.

31. A traveler as claimed in claim 30, wherein at least in the regions of said guide surfaces of said foot or base section of the traveler any portion of the latter which is made of cellular synthetic plastic material is covered by a wear-resistant layer of non-cellular synthetic plastic material.

32. A traveler as claimed in claim 31, wherein both said cellular synthetic plastic material and said non-cellular synthetic plastic material are nylon.

33. A traveler as claimed in claim 32, wherein said layer is reinforced by a fibrous matrix of an aramid fiber embedded therein.

* * * * *